US010022038B2

(12) United States Patent
Hansen et al.

(10) Patent No.: US 10,022,038 B2
(45) Date of Patent: Jul. 17, 2018

(54) DISHWASHER GUIDE RAIL ASSEMBLY

(71) Applicant: WHIRLPOOL CORPORATION, Benton Harbor, MI (US)

(72) Inventors: Matthew M. Hansen, Saint Joseph, MI (US); Ronald M. Nowell, Jr., Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/295,070

(22) Filed: Oct. 17, 2016

(65) Prior Publication Data

US 2018/0103828 A1 Apr. 19, 2018

(51) Int. Cl.
*A47L 15/50* (2006.01)
*A47B 88/487* (2017.01)

(52) U.S. Cl.
CPC ..... *A47L 15/507* (2013.01); *A47B 88/487* (2017.01); *A47B 2210/0043* (2013.01); *A47B 2210/0059* (2013.01)

(58) Field of Classification Search
CPC ..... A47L 15/507; A47L 15/50; A47L 15/502; A47B 2210/0059; A47B 2210/0043; A47B 88/487; A47B 88/493; A47B 2210/17; A47B 2088/401; A47B 2210/0037
USPC ..... 211/41.8, 151, 41.3–41.7; 312/228.1, 312/334.9, 334.12, 334.15, 334.18, 312/334.25, 334.26, 334.33, 334.37, 312/334.39, 334.43, 334.45, 334.13, 228
See application file for complete search history.

(56) References Cited

U.S. PATENT DOCUMENTS 2,559,380 A * 7/1951 Wikman ..... A47B 88/493 312/334.12
2,561,163 A * 7/1951 Wolters ..... A47B 88/493 312/334.13
2,566,186 A * 8/1951 Gillett ..... A47B 88/48 292/170
2,687,924 A * 8/1954 Gomersall ..... A47B 88/493 312/334.13
2,859,070 A * 11/1958 Gomersall ..... A47B 88/493 312/333
2,860,929 A * 11/1958 Gussack ..... A47B 88/487 384/19
2,880,040 A * 3/1959 Gomersall ..... A47B 88/493 312/334.13
3,096,125 A * 7/1963 Kendt ..... A47L 15/507 312/334.13

(Continued)

FOREIGN PATENT DOCUMENTS

CN 205126160 U 4/2016
DE 102006055349 B3 3/2008

(Continued)

*Primary Examiner* — Hiwot E Tefera
(74) *Attorney, Agent, or Firm* — McGarry Bair PC

(57) ABSTRACT

In one aspect, a dishwasher includes a tub at least partially defining a treating chamber and defining an access opening, a dishrack, and a guide rail assembly slidably mounting the dishrack to the tub. The guide rail assembly has a guide rail mounted to the dishrack or to the tub and has upper and lower tracks, which are spaced from each other by a predetermined height, and at least one pair of wheels comprising upper and lower wheels, which are rotatably mounted to the other of the dishrack or the tub.

14 Claims, 3 Drawing Sheets

(56) References Cited

U.S. PATENT DOCUMENTS

| | | | | | |
|---|---|---|---|---|---|
| 3,594,058 | A * | 7/1971 | Kauffman | A47L 15/507 | 312/298 |
| 3,726,581 | A * | 4/1973 | Doepke | A47B 88/407 | 312/311 |
| 3,744,646 | A | 7/1973 | Duncan et al. | | |
| 3,982,802 | A * | 9/1976 | Bailey | A47B 88/493 | 134/176 |
| 4,181,383 | A * | 1/1980 | Naef | A47B 88/493 | 312/334.13 |
| 4,288,137 | A * | 9/1981 | MacDonald | A47B 88/487 | 312/334.45 |
| 4,387,942 | A * | 6/1983 | Lense | A47B 88/487 | 312/334.41 |
| 4,535,524 | A * | 8/1985 | Jenkins | | |
| 4,595,247 | A * | 6/1986 | Zank | A47B 88/487 | 312/334.19 |
| 5,433,516 | A * | 7/1995 | Beals | A47B 47/02 | 312/257.1 |
| 6,619,772 | B2 * | 9/2003 | Dierbeck | B25H 3/028 | 312/334.1 |
| 8,708,434 | B2 * | 4/2014 | Oppel | A47L 15/507 | 211/41.8 |
| 9,462,930 | B2 * | 10/2016 | Bastuji | A47L 15/507 | |

FOREIGN PATENT DOCUMENTS

| | | | |
|---|---|---|---|
| DE | 202007013640 | U1 | 3/2009 |
| DE | 102010036314 | A1 | 5/2011 |
| GB | 1005912 | | 9/1965 |
| SE | 9002087 | L | 12/1991 |
| WO | 2008061887 | A1 | 5/2008 |

* cited by examiner

DISHWASHER GUIDE RAIL ASSEMBLY

BACKGROUND OF THE INVENTION

Contemporary automatic dishwashers for use in a typical household include a tub defining a treating chamber and a spraying system for recirculating liquid throughout the tub to remove soils from dishes and utensils. Upper and lower dishracks for holding dishes to be cleaned are typically provided within the treating chamber and mounted to the tub by extensible support rails. The dishwasher is generally provided with a door, pivotally mounted to the tub, that provides access to the treating chamber when the door is in the open position and also permits the upper and lower dishracks to extend from the treating chamber to the outside of the tub.

BRIEF DESCRIPTION OF THE INVENTION

In one aspect, a dishwasher includes a tub at least partially defining a treating chamber and defining an access opening, a dishrack, and a guide rail assembly slidably mounting the dishrack to the tub. The guide rail assembly has a guide rail mounted to the dishrack or to the tub and has upper and lower tracks, which are spaced from each other by a predetermined height, and at least one pair of wheels comprising upper and lower wheels, which are rotatably mounted to the other of the dishrack or the tub. The wheels have a diameter less than the predetermined height, with the upper wheel bearing against the upper track and the lower wheel bearing against the lower track.

In another aspect, a guide rail assembly includes a guide rail having upper and lower tracks, which are spaced from each other by a predetermined height, and at least one pair of wheels comprising upper and lower wheels having a diameter less than the predetermined height, with the upper wheel bearing against the upper track and the lower wheel bearing against the lower track.

DESCRIPTION OF EMBODIMENTS OF THE INVENTION

Figure 1:
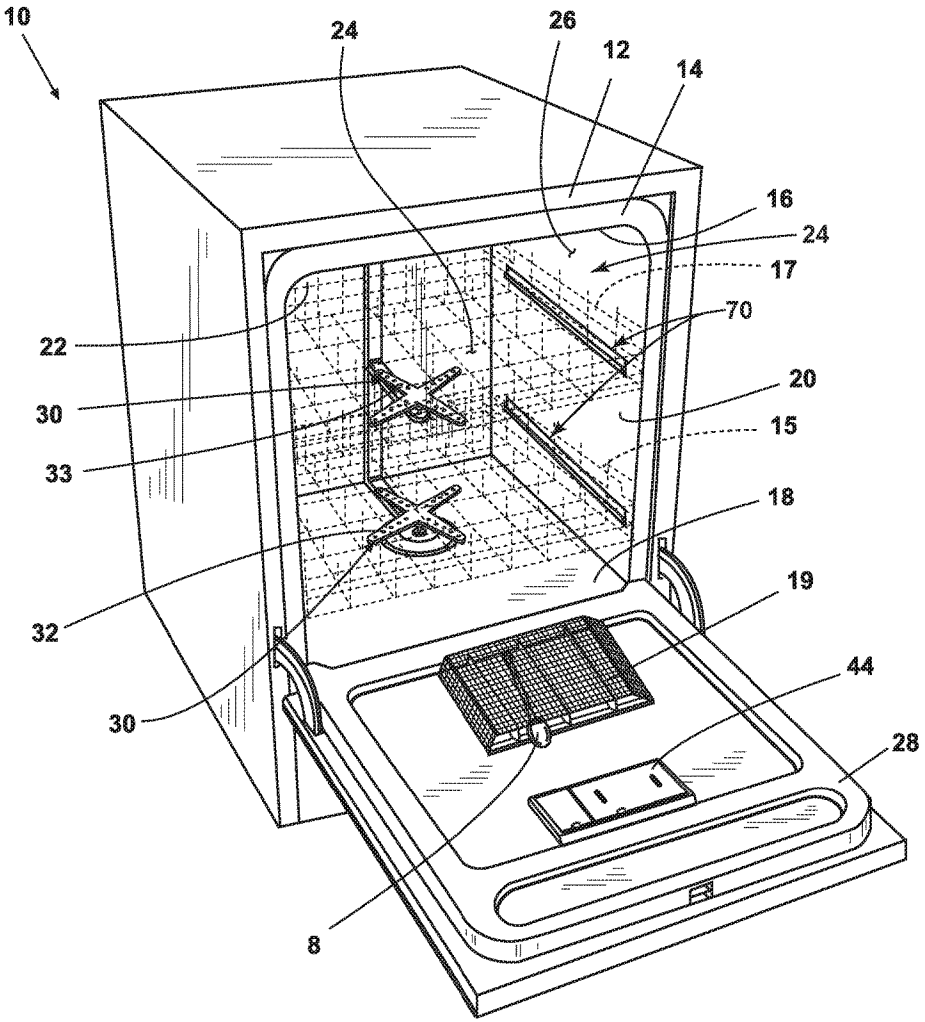
FIG. 1 is a perspective view of a first embodiment of a dishwasher, with the door open.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, a cabinet 12 of the dishwasher 10 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A tub 14 is disposed within the cabinet 12 and has spaced top and bottom walls 16 and 18, spaced side walls 20, and a rear wall 22. The walls 16, 18, 20, and 22 join along their respective edges to define a treating chamber 24 with an access opening 26. Utensil holders in the form of upper and lower dishracks 15, 17 are located within the treating chamber 24 and receive utensils for washing. The dishracks 15, 17 are typically mounted to side walls 20 for slidable movement in and out of the treating chamber 24 for ease of loading and unloading and can be in the form of a wire-frame. The dishracks 15, 17 can be mounted with a guide rail assemblies 70. Another utensil holder in the form of a silverware basket 19 is located on the door 28. The silverware basket 19 can be removably mounted to the door.

Utensil holders 15, 17 and 19 all hold various utensils for washing within the treating chamber. As used in this description, the term utensil is generic to dishes and the like that are washed in the dishwasher 10 and expressly includes, dishes, plates, bowls, silverware, glassware, stemware, pots, pans, and the like A utensil, in the form of a spoon 8, is shown located in the silverware basket 19.

A door 28 is hingedly mounted to the dishwasher 10 and can move between an opened position, as illustrated in FIG. 1, to provide access to the treating chamber 24 and a closed position (shown in FIG. 2) to close the treating chamber 24 by covering the access opening 26 of the treating chamber 24. Typically, the door 28 is in the opened position when utensils are loaded or unloaded into the dishwasher 10 and in the closed position while the washing cycle is running or while the dishwasher 10 is not in use. A bulk wash aid dispenser 44 is mounted on an inside surface of the door 28 such that the bulk wash aid dispenser 44 is disposed in the treating chamber 24 when the door 28 is in the closed position.

Additionally, the dishwasher 10 comprises a liquid circulation system 30 for introducing and circulating liquid and wash aids, such as detergents, rinse aids, and the like, throughout the treating chamber 24. The liquid circulation system comprises a pump located in a lower portion or sump of the tub 14 and which pumps liquid to sprayers 32 and 33. Sprayers 32, 33 are located, respectively, beneath lower rack 15 and upper rack 17 and are illustrated as rotating spray arms. Another sprayer can be located above the upper rack 17 and is illustrated as a fixed spray nozzle.

Figure 2:
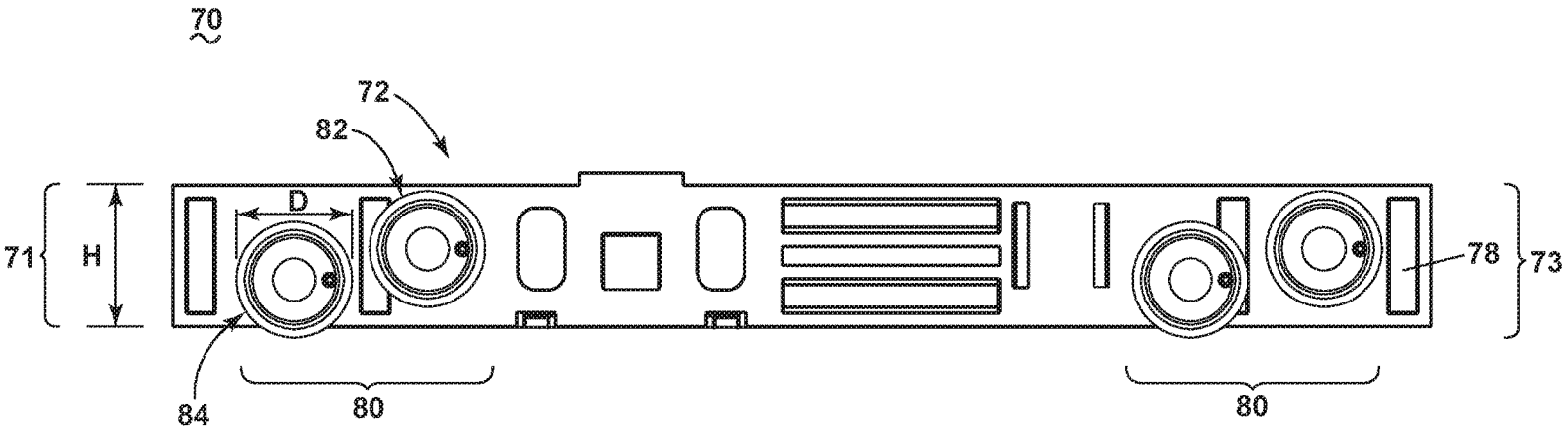
FIG. 2 is a side view of a guide rail assembly according to an embodiment of the invention.

FIG. 2 illustrates a front view of a guide rail assembly 70 according to an embodiment of the present invention. The guide rail assembly 70 slidably mounts dishracks 15, 17 to the side walls 20 of the tub 14 so that the dishracks 15, 17 can glide in and out of the access opening 26 of the treating chamber 24. The guide rail assembly 70 comprises a guide rail 72 and at least one pair of wheels 80. FIG. 2 illustrates a guide rail assembly 70 comprising two pairs of wheels 80 wherein a first pair of wheels 80 is located proximate a first end 71 of the guide rail 72 and a second pair of wheels 80 is located proximate a second end 73 of the guide rail 72, opposite the first end. While two pairs of wheels 80 are shown, it is within the scope of the invention to use only one pair of wheels 80, or more than two pairs of wheels 80. The guide rail 72 can be mounted to the dishracks 15, 17 or the tub 14 and comprises an upper track 74 and a lower track 76, which are spaced from each other by a predetermined height H. The at least one pair of wheels 80 comprises an upper wheel 82 and a lower wheel 84 each having a diameter D and can be laterally spaced from each other along a longitudinal extent of the guide rail 72 such that the wheels 82, 84 do not occupy the same vertical space. The diameter D of each of the upper and lower wheels 82, 84 is less than the predetermined height H of the guide rail 72, and it is not necessary that the diameter D of the upper and lower wheels 82, 84 be equal. The pair of wheels 80 may be rotatably mounted to the other of the dishrack 15, 17 or the tub 14 by way of a socket 77 disposed on an axle 78. In the case that the guide rail 72 is mounted to the tub 14, the pair of wheels can be mounted to the dishrack 15, 17. Alternatively, if the guide rail 72 is mounted to the dishrack 15, 17 the pair of wheels 80 can be mounted to the tub 14. The upper wheel 82 can bear against the upper track 74, while the lower wheel 84 can bear against the lower track 76.

Figure 3:
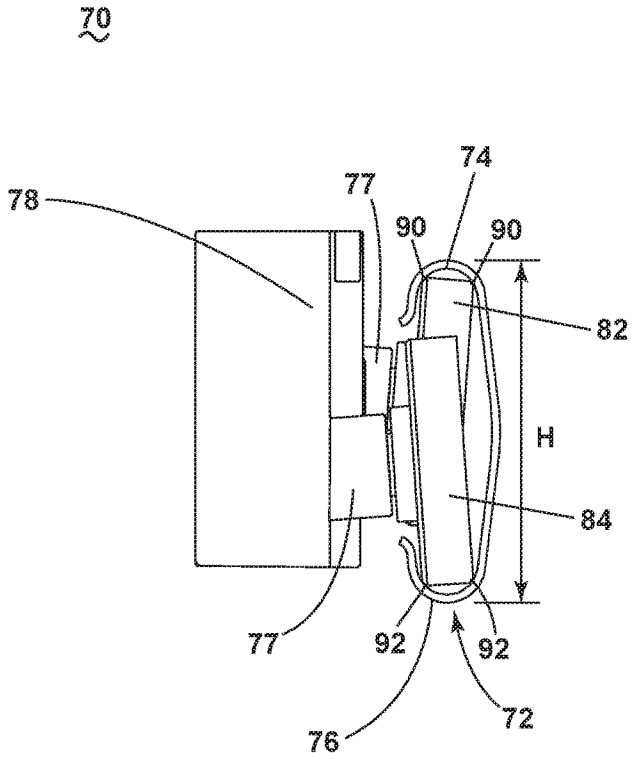
FIG. 3 is front view of a guide rail assembly according to an embodiment of the invention.

As best seen in FIG. 3, the guide rail 72 has a C-shaped cross-section. The upper and lower tracks 74, 76 can be non-flat and can have a generally arcuate shape. When the upper and lower wheels 82, 84 bear against the corresponding upper and lower tracks 74, 76, two points of contact 90, 92 result for each upper and lower wheel 82, 84. In the case that the upper and lower tracks 74, 76 have an arcuate shape the upper and lower wheels 82, 84 can have chamfered or beveled edges which abut the arcuate tracks 74, 76 at the two points of contact 90, 92, respectively.

The embodiments described herein can be used to slidably mount a dishrack in a dishwasher, ensuring that the wheels of the guide rail assembly roll freely without opposing forces. These embodiments can be used to avoid the undesirable circumstances when wheels bind up due to opposing forces.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber and defining an access opening;

a dishrack; and a guide rail assembly slidably mounting the dishrack to the tub and comprising:

a guide rail mounted to one of the dishrack and tub and having upper and lower tracks, which are spaced from each other by a predetermined height to define an interior and wherein at least one of the upper track or lower track is non-flat wherein an uppermost interior surface of the upper track is arcuate to define an uppermost interior arcuate surface and a lowermost interior surface of the lower track is arcuate to define a lowermost interior arcuate surface; and at least one pair of wheels comprising an upper wheel and a lower wheel, which are rotatably mounted to the other of the dishrack and tub by way of a respective socket, each socket located outside the guide rail, and the upper and lower wheels are located within the interior and each have a diameter less than the predetermined height, with the upper wheel bearing against the uppermost interior arcuate surface and the lower wheel bearing against the lowermost interior arcuate surface and wherein the corresponding upper wheel or lower wheel contacts the non-flat track at an arcuate surface along two points of contact of the corresponding upper wheel or lower wheel and wherein the upper and lower wheels are laterally spaced from each other along a longitudinal extent of the guide rail.

2. The dishwasher of claim 1 wherein the guide rail has a C-shaped cross section.

3. The dishwasher of claim 1 wherein there are at least two pairs of wheels.

4. The dishwasher of claim 3 wherein one pair of wheels is located proximate a first end of the guide rail and a second pair of wheels is located proximate a second end of the guide rail, opposite the first end.

5. The dishwasher of claim 1 wherein the at least one pair of wheels is rotatably mounted to the dishrack.

6. The dishwasher of claim 5 wherein the guide rail is mounted to the tub.

7. The dishwasher of claim 6 wherein the guide rail is slidably mounted to the tub.

8. The dishwasher of claim 1 wherein the corresponding upper wheel or lower wheel has beveled edges, which abut the arcuate surface to define the two points of contact.

9. The dishwasher of claim 1 wherein the dishrack comprises a wire-frame rack.

10. A guide rail assembly comprising:

a guide rail, configured to be mounted to one of a dishrack or tub in a dishwasher, the guide rail having upper and lower tracks, which are spaced from each other by a predetermined height to define an interior and wherein an uppermost interior surface of the upper track is arcuate to define an uppermost interior arcuate surface and a lowermost interior surface of the lower track is arcuate to define a lowermost interior arcuate surface; and at least one pair of wheels located within the interior and the at least one pair of wheels comprising upper and lower wheels which are rotatably mounted to the other of the dishrack and the tub by way of a respective socket, wherein each socket is located outside of the guide rail, where the upper and lower wheels each have a diameter less than the predetermined height, with the upper wheel bearing against the uppermost interior arcuate surface and the lower wheel bearing against the lowermost interior arcuate surface and wherein the upper and lower wheels are laterally spaced from each other along a longitudinal extent of the guide rail.

11. The guide rail assembly of claim 10 wherein the guide rail has a C-shaped cross section.

12. The guide rail assembly of claim 10 wherein there are at least two pairs of wheels.

13. The guide rail assembly of claim 12 wherein one pair of wheels is located proximate a first end of the guide rail and a second pair of wheels is located proximate a second end of the guide rail, opposite the first end.

14. The guide rail assembly of claim 10 wherein the corresponding upper wheel or lower wheel abuts the arcuate surface at two points of contact.

* * * * *